United States Patent [19]

Griston et al.

[11] Patent Number: 5,072,387

[45] Date of Patent: Dec. 10, 1991

[54] METHOD FOR DETERMINING A TRANSIT TIME FOR A RADIOACTIVE TRACER

[75] Inventors: Suzanne Griston, San Dimas; Frank L. Cire, Pomona, both of Calif.

[73] Assignee: Chevron Research and Technology Company, San Francisco, Calif.

[21] Appl. No.: 454,105

[22] Filed: Dec. 20, 1989

[51] Int. Cl.[5] ..... G01V 1/00; E21B 43/24; E21B 33/13

[52] U.S. Cl. ..... 364/422; 364/421; 376/209; 166/272; 166/292; 166/117.5

[58] Field of Search ..... 364/422, 421; 73/155; 166/272, 292, 117.5; 376/209

[56] References Cited

U.S. PATENT DOCUMENTS

| | | | |
|---|---|---|---|
| 3,993,131 | 11/1976 | Riedel | 73/155 |
| 4,168,746 | 9/1979 | Sheely | 73/155 |
| 4,223,727 | 9/1980 | Sustek, Jr. et al. | 73/155 |
| 4,224,988 | 9/1980 | Gibson et al. | 73/155 |
| 4,228,855 | 10/1980 | Sustek, Jr. et al. | 73/155 |
| 4,470,462 | 9/1984 | Hutchison | 166/292 |
| 4,487,264 | 12/1984 | Hyne et al. | 166/272 |
| 4,501,329 | 2/1985 | DePriester | 166/292 |
| 4,507,552 | 3/1985 | Roesner et al. | 73/155 |
| 4,730,263 | 3/1988 | Mathis | 364/422 |
| 4,763,734 | 8/1988 | Dickinson et al. | 166/117.5 |
| 4,793,414 | 12/1988 | Nguyen et al. | 166/252 |
| 4,817,713 | 4/1989 | Nguyen et al. | 166/252 |

OTHER PUBLICATIONS

D. E. Bookout, J. J. Glenn, Jr. and H. E. Schaller, "Injection Profiles During Steam Injection", American Petroleum Institute; Production Division; Pacific Coast District Meeting, May 2–4, 1967, Paper No. 801–43C.

*Primary Examiner*—Dale M. Shaw
*Assistant Examiner*—Xuong M. Chung
*Attorney, Agent, or Firm*—Edward J. Keeling; Matt W. Carson

[57] ABSTRACT

An improved method for deteriming the transit time of a radioactive tracer for steam injection profiles in steam injection wells is disclosed. Radiation decay data is collected at two detectors at different depths. The data is then transformed into a new data set, consisting of time intervals between successive decay events. Tracer radiation decay events are distinguished from background radiation decay events by using statistical methods to establish a high probability that background radiation decay events are excluded. The total set of time intervals are then divided into subgroups of a specified sample size. The arrival time of the tracer is determined as the first time at which a specified minimum number of identified tracer radiation decay events occur successively.

2 Claims, 8 Drawing Sheets

METHOD FOR DETERMINATION OF TRACER ARRIVAL TIME

NOMENCLATURE $N_E$ = TOTAL NUMBER OF DECAY EVENTS $\Delta t$ = TIME INTERVAL BETWEEN SUCCESSIVE DECAY EVENTS $\overline{\Delta T}$ = AVERAGE OF TIME INTERVALS FOR TRACER DECAY EVENTS $\sigma$ = STANDARD DEVIATION OF TIME INTERVALS FOR TRACER DECAY EVENTS $v$ = DEGREES OF FREEDOM $\tau$ = CONFIDENCE INTERVAL FOR OUTLIER TEST $n$ = SUBGROUP SIZE $P$ = DESIRED PROBABILITY OF DETECTING TRUE TRACER ARRIVAL TIME $\tau_p$ = CONFIDENCE INTERVAL FOR TRACER ARRIVAL TIME $t_k$ = TIME AT WHICH DECAY EVENT k OCCURS $T_{ARRIVAL}$ = ARRIVAL TIME OF TRACER SLUG AT DETECTOR

EXAMPLE OF RECORDED RADIATION DECAY EVENTS

IDEAL DETECTOR RESPONSE CURVE

TRANSFORMED DETECTOR RESPONSE DATA

TYPICAL LOGGING COMPANY RESPONSE CURVE

METHOD FOR DETERMINATION OF TRACER ARRIVAL TIME

NOMENCLATURE $N_E$ = TOTAL NUMBER OF DECAY EVENTS $\Delta t$ = TIME INTERVAL BETWEEN SUCCESSIVE DECAY EVENTS $\overline{\Delta T}$ = AVERAGE OF TIME INTERVALS FOR TRACER DECAY EVENTS $\sigma$ = STANDARD DEVIATION OF TIME INTERVALS FOR TRACER DECAY EVENTS $v$ = DEGREES OF FREEDOM $\tau$ = CONFIDENCE INTERVAL FOR OUTLIER TEST $n$ = SUBGROUP SIZE $P$ = DESIRED PROBABILITY OF DETECTING TRUE TRACER ARRIVAL TIME $\tau_p$ = CONFIDENCE INTERVAL FOR TRACER ARRIVAL TIME $t_k$ = TIME AT WHICH DECAY EVENT k OCCURS $T_{ARRIVAL}$ = ARRIVAL TIME OF TRACER SLUG AT DETECTOR FIG_6 (cont.)

EXAMPLE PLOT OF $\overline{\Delta T}_{k,k+n}$ VERSUS ELAPSED TIME

METHOD FOR DETERMINING A TRANSIT TIME FOR A RADIOACTIVE TRACER

CROSS REFERENCE TO RELATED APPLICATIONS

This application is related to co-assigned U.S. Pat. Nos. 4,793,414 and 4,817,713, and to co-assigned application Ser. No. 322,582 filed Mar. 13, 1989.

FIELD OF THE INVENTION

This invention relates generally to thermally enhanced oil recovery. More specifically, this invention provides a method for reliably and accurately determining the transit time of a radioactive tracer for steam injection profiles in steam injection wells.

BACKGROUND OF THE INVENTION

In the production of crude oil, it is frequently found that the crude oil is sufficiently viscous to require the injection of steam into the petroleum reservoir. Ideally, the petroleum reservoir would be completely homogeneous and the steam would enter all portions of the reservoir evenly. However, it is often found that this does not occur. Instead, steam selectively enters a small portion of the reservoir while effectively bypassing other portions of the reservoir. Eventually, "steam breakthrough" occurs and most of the steam flows directly from an injection well to a production well, bypassing a large part of the petroleum reservoir.

It is possible to overcome this problem with various remedial measures, e.g., by plugging off certain portions of the injection well. For example, see U.S. Pat. Nos. 4,470,462 and 4,501,329, assigned to the assignee of the present invention. However, to institute these remedial measures, it is necessary to determine which portions of the reservoir are selectively receiving the injected steam. This is often a difficult problem.

Various methods have been proposed for determining how injected steam is being distributed in the wellbore. Bookout ("Injection Profiles During Steam Injection", API Paper No. 801-43C, May 3, 1967) summarizes some of the known methods for determining steam injection profiles and is incorporated herein by reference for all purposes.

The liquid and vapor phase distributions within a steam injection wellbore are important in the evaluation of steamflood performance. They can indicate which parts of the reservoir have been steamed and which may have been bypassed. Recently, radioactive tracer surveys have become more widely used to determine steam injection profiles. The surveying technique measures the transit time of a slug of a radioactive tracer between two downhole gamma radiation detectors. Preferably, inert radioactive gases, such as Argon, Krypton, or Xenon are used to trace the vapor phase and sodium iodide is used to trace the liquid phase. Methyl iodide has also been used to trace the vapor phase of the steam. For example, see U.S. Pat. Nos. 4,793,414; 4,817,713; 4,507,552, and an article by Davarzani and Roesner entitled "Surveying Steam Injection Wells Using Production Logging Instruments" dated Aug. 1985 and which describes U.S. Pat. No. 4,223,727.

In U.S. Pat. Nos. 4,507,552 and 4,223,727, radioactive Iodine is injected into the steam between the injection well and the steam generator. The tracer moves down the tubing with the steam until it reaches the formation, where the tracer is temporarily held on the face of the formation for several minutes. A typical gamma radiation log is then run immediately following the tracer injection. The recorded gamma radiation intensity at any point in the well is then assumed to be proportional to the amount of steam injected at that point.

Another prior art method to estimate injectivity into an injection well consists of measuring the volume of fluid and radioactive tracers injected with surface metering equipment, as described in U.S. Pat. No. 4,223,727.

The vapor phase tracers have variously been described as alkyl halides (methyl iodide, methyl bromide, and ethyl bromide) or elemental iodine. Although it has previously been believed that these alkyl halide vapor tracers were not subject to decomposition in the short time periods involved, it has been noted that the above materials undergo chemical reactions that dramatically affect the accuracy of the results of the survey in steam injection profiling as described in related U.S. Pat. Nos. 4,793,414 and 4,817,713.

A prior art method of determining relative liquid and vapor phase profiles in a steam injection well comprises the steps of inserting a well logging tool into the well at a first location, the tool comprising two gamma radiation detectors, one detector located a fixed distance above the second detector. A radioactive, liquid phase tracer is then injected, to determine a liquid transit time between the first and second gamma radiation detectors. A thermally stable, radioactive vapor phase tracer, such as Krypton, Xenon, or Argon gas, is then injected into the steam injection well and a vapor transit time between said first and said second gamma radiation detector is determined. The dual detector tool is then lowered to the next location and another slug of liquid or vapor phase tracer is injected.

The vapor or liquid injection profile in the perforated interval is then determined from the transit times at the different depths. For example, see U.S. Pat. Nos. 4,793,414 and 4,817,713.

An additional application has been proposed in which vapor and liquid velocities are used with measured bottomhole temperature or pressure and measured wellhead mass flow rate and vapor mass fraction of the two-phase steam to estimate the vapor mass fraction downhole. For examples, see U.S. Pat. Nos. 4,817,713 and 4,793,414. However, the accuracy of the estimated downhole vapor mass fraction primarily depends on the accuracy of the computed phase velocities.

Field experience with various prior art methods of steam profiling has shown considerable difficulty with repeatability and interpretation of results. Further evaluation of the practical application of radioactive tracer surveys to steam injection wells has shown that existing data analysis methods are not appropriate to determine short tracer transit times associated with steam injection wells. Because radiation particles are emitted randomly from background sources as well as from the tracer slug, it is important to distinguish tracer radiation decay events from background radiation levels. The current methods used by logging companies do not do this. As a result, detection of background radiation can often be falsely interpreted as detection of the tracer slug. In addition, it is important to avoid subjective interpretation of the detector response data. This means that automated data processing and evaluation are required. In general, automated methods are preferred over manual methods because they reduce analysis time, eliminate human error, and provide consistent and reliable results.

The signal transmitted by each detector is the occurrence of radiation decay events. The time of each decay event is recorded and stored for real-time and subsequent analysis. In the prior art, the signal from each detector is transformed to obtain a plot showing the number of recorded radiation decay events occurring within fixed time intervals. Ideally, this plot will exhibit a Gaussian distribution. Count rates are determined by counting the number of radiation decay events that occur within a fixed time interval. The arrival time of the tracer slug at the detector is identified as the time when the maximum or peak number of recorded decay events occurs or the time when the first significant increase in the number of decay events occurs. This method requires that very small time intervals be used to accurately identify tracer arrival times. For example U.S. Pat. No. 4,861,986 which issued Aug. 29, 1989, still teaches the method of selecting peaks to obtain measurements of the fluid flow velocity in leaks through a casing. Two radioactive isotopes are injected, which are theoretically distinguishable from one another.

In the application of radioactive tracers to steam injection profiling, a limited number of the total tracer decay events are detected. High vapor velocities associated with steam injection often create long tracer slugs of reduced concentration that pass by the detector quickly. Therefore, it can be difficult in these prior art methods to detect tracer decay events above background radiation levels. In addition, the high vapor velocities can result in very short tracer transit times between detectors. In some cases, transit times can be less than 0.2 seconds, making it difficult to evaluate and interpret tracer surveys using existing methods, as previously described.

Modifications to existing methods have recently been applied in attempt to account for the limited number of recorded decay events. The raw detector signal output is transformed into time intervals, $\Delta t$, between successive radiation decay events. The frequency, f, of the decay events at a given elapsed time are then obtained by using the inverse relationship, $f=1/\Delta t$. Exponential decline curves are used to fill in the gaps between discrete frequency values and additional smoothing techniques are used to obtain a continuous curve. Unfortunately, this final smoothed curve exhibits multiple peaks with widely varying shapes and does not represent the actual detector response. As a result, peak or leading-edge determination of the tracer arrival time becomes difficult, if not impossible.

An estimate of the accuracy of each frequency, determined from $1/\Delta t$, can be obtained from $$\text{Accuracy of } f = f +/- u_f$$

where $U_f$ is the uncertainty of the frequency. If, for example, a 95% confidence level is used to define the uncertainty, then the accuracy of the frequency is given as $$\text{Accuracy of } f = f +/- 2\sigma$$

where $\sigma$ is the standard deviation of the frequency. Since each frequency is based on a single value of $\Delta t$, its corresponding standard deviation is expressed as $$\sigma = \sqrt{\frac{f}{\Delta t}} = \frac{1}{\Delta t} = f$$

Therefore, the frequency of decay events obtained from values of $1/\Delta t$ are only accurate to within +/− two times itself. The true value of the decay event frequency falls somewhere within the range of −f to +3f, which indicates the large uncertainties associated with this method.

In the application of radioactive tracers to steam injection wells, a limited number of the total tracer decay events are detected. This results from the fact that the detector is exposed to the tracer for a very short time and that low levels of gamma radiation are used. Both exposure time and radiation level cannot be varied enough to significantly increase the number of detectable decay events. Increasing the time interval in which the decay events are counted decreases the accuracy of the estimated time that the count rates occur.

The existing methods are limited in the degree of accuracy attainable for determining the exact arrival time of a slug of radioactive tracer. High vapor velocities associated with steam injection can result in very short transit times between detectors. In some cases, transit times can be less than 0.2 seconds, making it difficult to evaluate and interpret tracer surveys. As a result, this limitation prevents an accurate determination of which portions of the reservoir are selectively receiving the injected steam. There is, therefore, still a need for a method of determining the arrival time at each detector, and the transit time between dual detectors, for a slug of radioactive tracer that is accurate, reliable, and practical to perform.

SUMMARY OF THE INVENTION

A method of reliably and accurately determining a transit time of a radioactive tracer in a well is described. The method generally comprises the steps of inserting a first upper, and second lower gamma radiation detector at known depths in said well; collecting raw radiation decay data at each of said detectors, said decay data comprising background noise and tracer radiation decay events which are distinguishable from said background noise; transforming said raw radiation decay data collected at each of said detectors into a new data set, consisting of time intervals between successive decay events, and having a number of members equal to the total number of collected radiation decay events minus one, $N_E-1$; utilizing certain statistical criterion, such as outlier tests, to distinguish tracer radiation decay events from background radiation decay events, for each of said detectors; computing an average and a standard deviation of said time intervals between successive tracer decay events as identified by an outlier test, for each detector; establishing an acceptable range or limit about said average time interval, based on a specified confidence level, such as 95% confidence level, which indicates that there is a 95% probability that the average time interval for the true tracer slug will fall within this limit; dividing said total set of $N_E-1$ time intervals into subgroups of a specified sample size, n, such that there are $N_E-n$ number of subgroups consisting of the members $\Delta t_k$, $\Delta t_{k+1}$, $\Delta t_{k+2}$, $\Delta t_{k+n}$, where k is a counter that goes from 1 to $N_E-n$, for each of said detectors; determining an average time interval for each of said subgroups, and identifying a first subgroup which satisfies said acceptable limit at each detector; setting the radioactive tracer arrival time, $T_{arrival}$, equal to the time of decay event k, $tt_k$, at each of said detectors; and computing said transit time, $\Delta T_{transit}$, of said radioactive tracer between said gamma radiation detectors, wherein $$\Delta T_{transit} = T_{arrival,\ \text{bottom detector}} - T_{arrival,\ \text{top detector}}.$$

DETAILED DESCRIPTION OF THE INVENTION

In accordance with the present invention, a new improved method and means for analyzing detector data to reliably and accurately determine a transit time for a radioactive tracer has been developed. Tracer arrival time at the detector is determined from the following identification criteria:

1. Distinguish tracer radiation decay events from background radiation decay events.
2. Determine a statistical limit that establishes a high probability that background radiation decay events are not included in the evaluation of tracer transit time.
3. The arrival time of a tracer slug at a detector is determined as the first time at which a specified minimum number of identified tracer radiation decay events occur successively.

One embodiment pertains to determining the steam injection profile of a steam injection well. Steam is generated in steam generator and injected into a steam injection well through tubing and perforations into a petroleum bearing formation. As is the case with all injection profiling methods, it is important that the rate and quality of the steam injected at the wellhead be maintained at relatively steady conditions so as to minimize errors introduced during the profiling survey. Large fluctuations in surface injection conditions can either mask true profile changes or indicate false profile changes. Therefore, fluctuations in the surface injection conditions should be much smaller than the expected profile variation across the perforated interval.

Initially, a well logging tool is used to develop temperature and/or pressure profiles which enable the determination of vapor and liquid densities from steam tables known in the art. The well logging tool is then returned to the bottom of perforated zone. Vapor phase profiles are preferably performed first, although it is possible to perform liquid phase profiles first. If liquid phase profiles are performed first, the wellbore may remain somewhat radioactive and mask vapor phase results. A slug of liquid phase tracer is then injected into steam line. A sufficient quantity of tracer is injected to permit easy detection at the gamma radiation detector. This quantity will vary radically depending on the steam flow rate and steam quality, but can readily be calculated by one skilled in the art.

The logging tool is of a type well known in the art and contains gamma radiation detectors. Instrumentation and recording equipment are used to collect and store the raw signal output from the detectors for real-time and subsequent remote analysis to determine tracer transit times.

Figure 1:
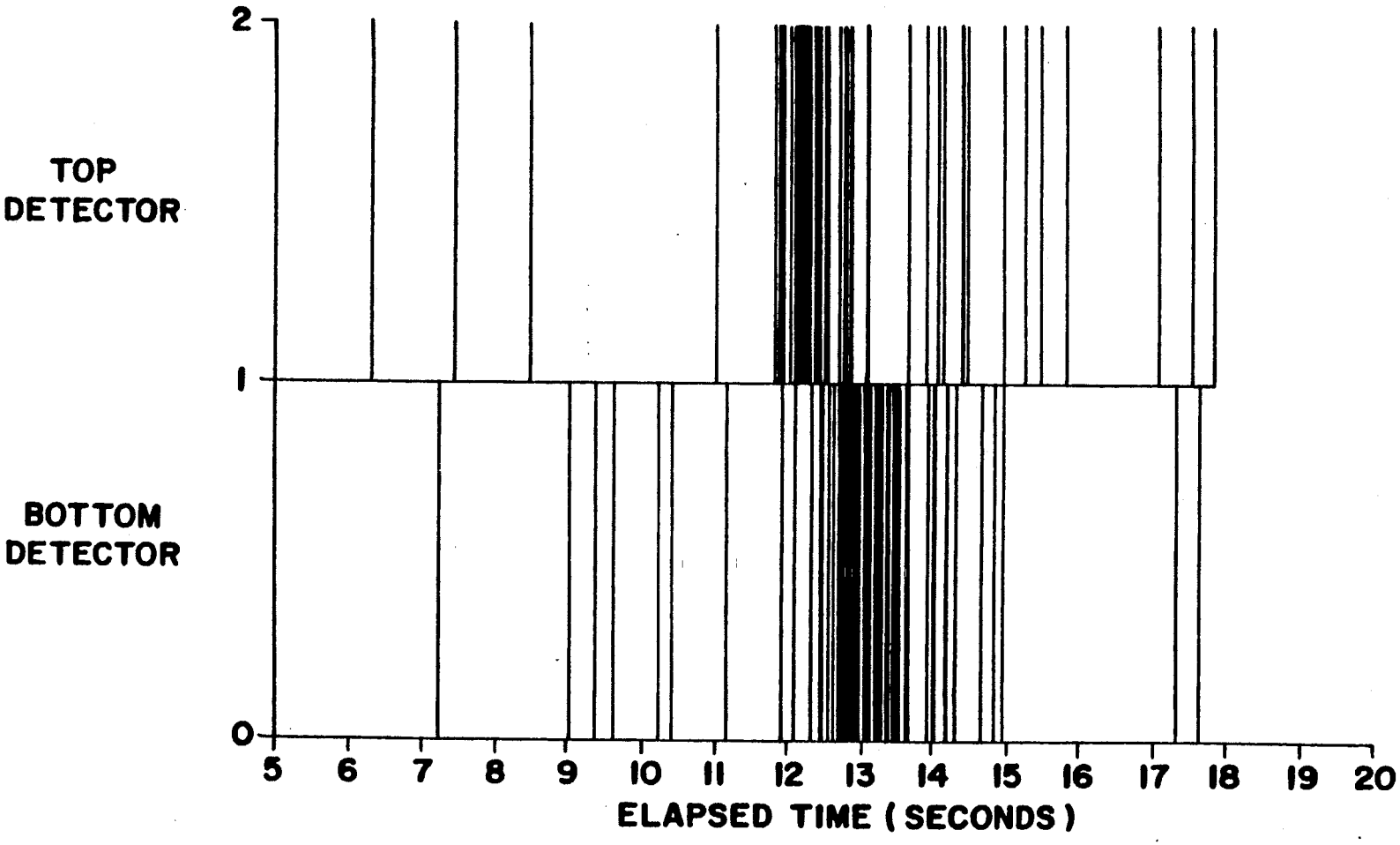
FIG. 1 is a plot showing the raw signal output of two gamma radiation detectors for a steam vapor survey using Krypton gas as the tracer. The top half of the plot shows the output signal from the top detector, while the bottom half of the plot shows the output signal from the bottom detector. The occurrence of a radiation decay event is depicted by a solid vertical line.

Examples of raw signal output from two gamma detectors are shown in FIG. 1 for a 15-second collection interval using a 50 milliCurie slug of radioactive Krypton gas to trace steam vapor. The top half of the plot shows the output signal from the top detector, while the bottom half of the plot shows the output signal from the bottom detector. The occurrence of a radiation decay event is depicted by a solid vertical line. Approximately 40 to 50 radiation decay events, from both background radiation and tracer radiation, were recorded at each detector. The frequency at which these decay events occur is on the order of 0 to 5 counts/second for background radiation and 50 to 200 counts/second for tracer radiation.

Figure 2:
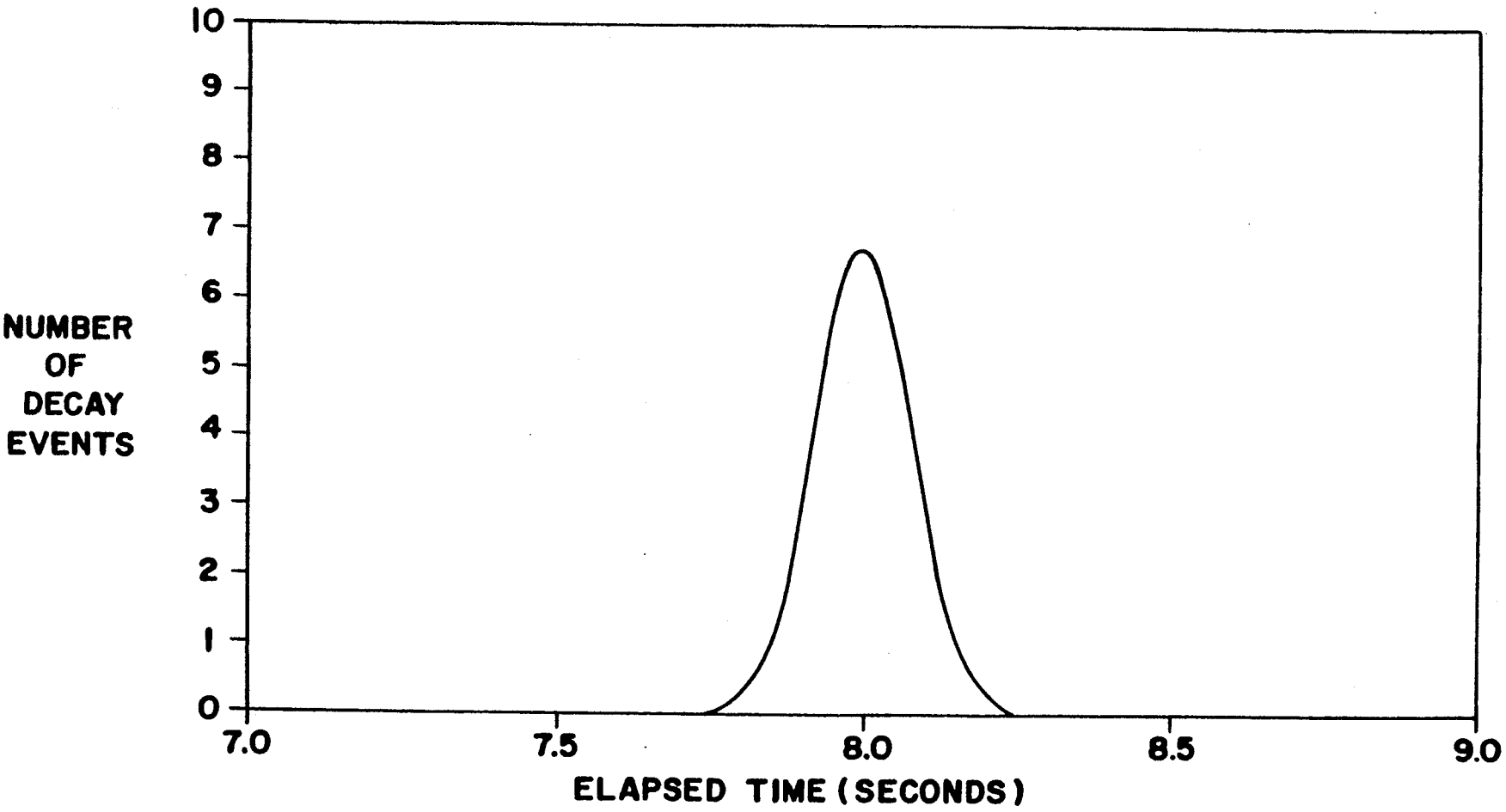
FIG. 2 is a plot showing an ideal detector response curve obtained by counting the number of radiation decay events recorded within fixed time intervals. This plot depicts the condition where the total number of recorded decay events is large, say greater than 1000 total events, in which case the response curve exhibits a Gaussian distribution.

The arrival time of the radioactive tracer at the detector is identified as the time when the maximum or peak count rate occurs or the time when the first significant increase in count rate occurs. Ideally, each response curve should have a single sharp peak or leading edge, for reliable arrival time measurements, as shown in FIG. 2.

Figure 3:
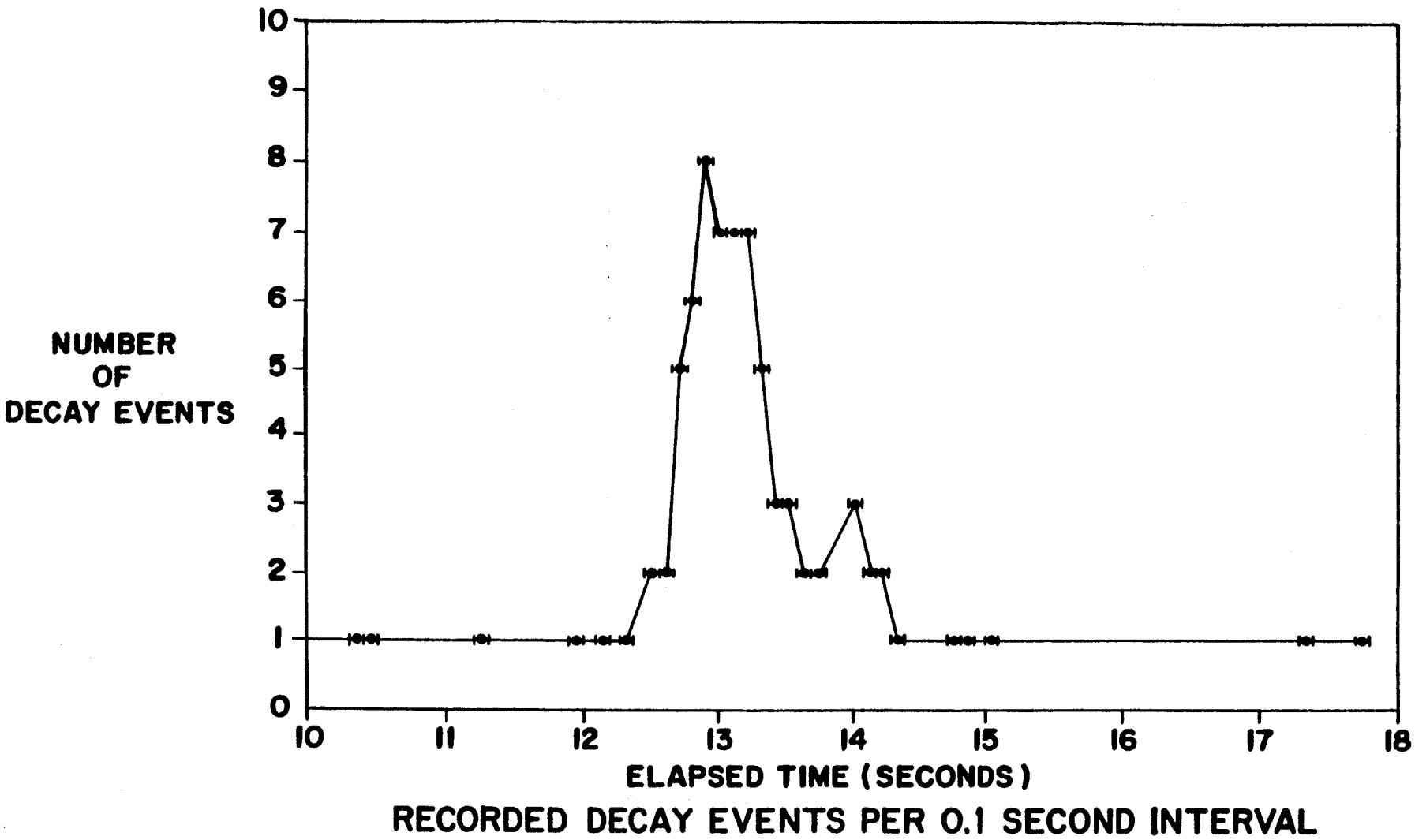
FIG. 3 is a plot showing detector response curve obtained using actual detector data for a steam vapor survey using Krypton gas as the tracer.

An example of a response curve is shown in FIG. 3 for a vapor survey using Krypton gas as the tracer, where the number of recorded radiation decay events are counted for each 0.1 second interval. This plot depicts the frequency of recorded decay events versus time used to identify the presence of the tracer slug and its corresponding arrival time at the detector. Because of the limited number of recorded decay events, it is difficult to clearly identify the exact location of the maximum or peak value of the counts. In this case, even if the peak were clearly identifiable, the tracer arrival time would only be accurate to +/− half of the time interval. In this example, the arrival time would be accurate to +/−0.05 seconds for each detector. Consequently, the tracer transit time between dual detectors would only be accurate to +/−0.1 seconds.

Figure 4:
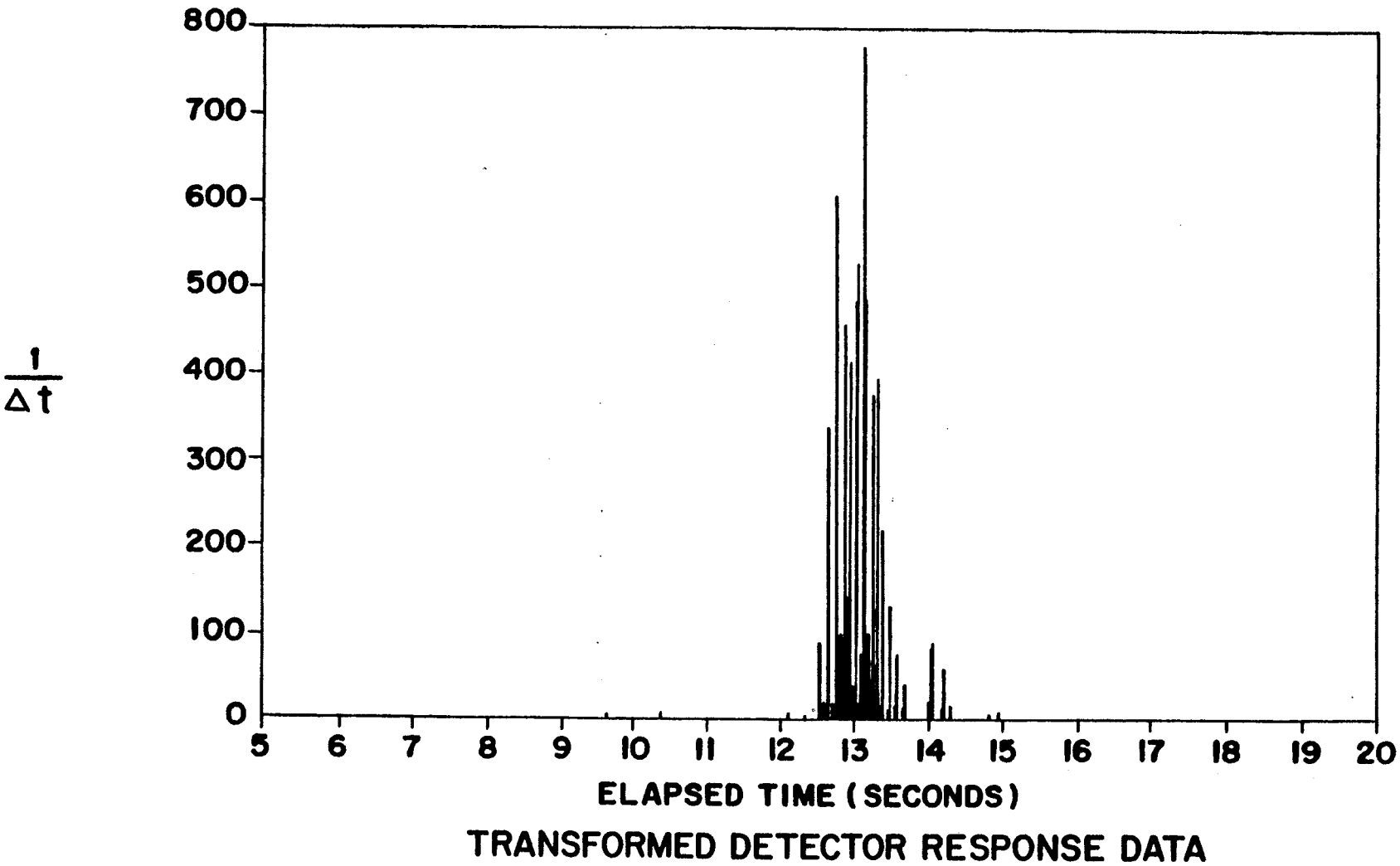
FIG. 4 is a plot showing raw detector data transformed to $1/\Delta t$, to illustrate an intermediate analysis step used in existing methods to determine tracer transit times.
Figure 5:
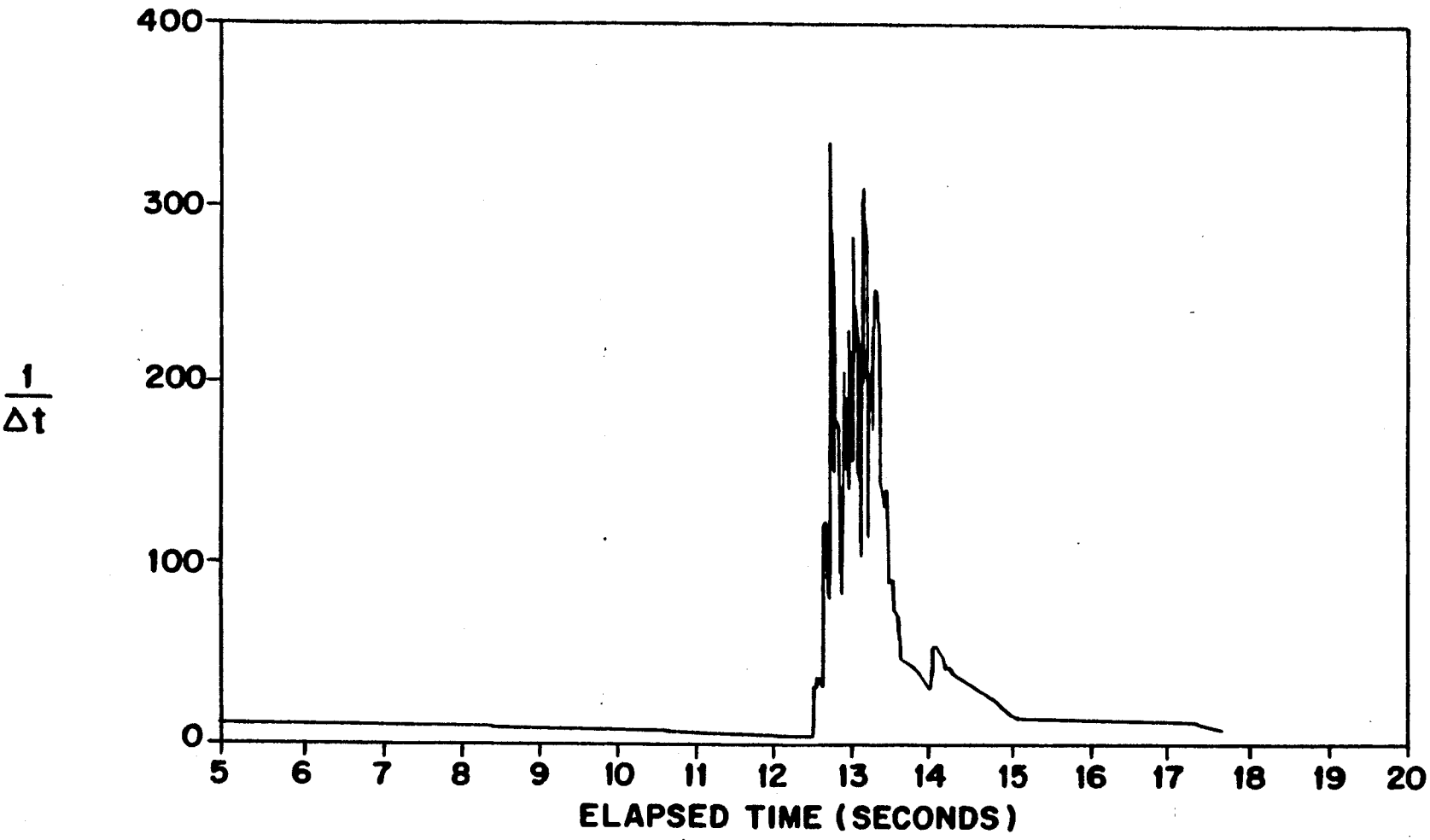
FIG. 5 is a plot showing a detector response curve, based on count rates obtained from $1/\Delta t$ data and including smoothing between data points, to illustrate existing methods of determining tracer transit times.

FIG. 4 shows the detector data transformed to 1/dT to illustrate a intermediate analysis step, used in prior art methods to determine count rate. FIG. 5 shows the resulting response curve of count rate v. time using 1/dT data; using prior art method. Note that final smoothed curve exhibits multiple peaks with widely varying slopes, and does not represent the actual detector response. As a result, peak or leading edge of the trace arrival time is extremely difficult using the prior art methods.

The new, improved method uses criteria to identify the arrival time of a radioactive tracer at each detector based on existing probability and statistic theory which provide more reliable and precise means of evaluating the raw signal output from each detector. For example, statistical outlier tests such as the Thompson $\tau$ Technique and the Grubbs Method can be used to distinguish tracer radiation decay events from background radiation decay events for each set of detector output data. These outlier methods are described in an article by Thompson entitled "On a Criterion for the Rejection of Observations and the Distribution of the Ratio of the Deviations to Sample Standard Deviation" and an article by Grubbs entitled "Procedures for Detecting Outlying Observations in Samples".

In most statistical outlier tests, the probability for rejecting a good data point, $P_R$, (in this case excluding a true tracer decay event from the evaluation of tracer arrival time) is usually set at 5%. The value of $P_R$ can be set higher or lower depending upon the level of confidence desired. However, using a very low probability of rejecting a good data point increases the probability of accepting bad data points (in this case, including background decay events in the determination of tracer arrival times).

Figure 6:
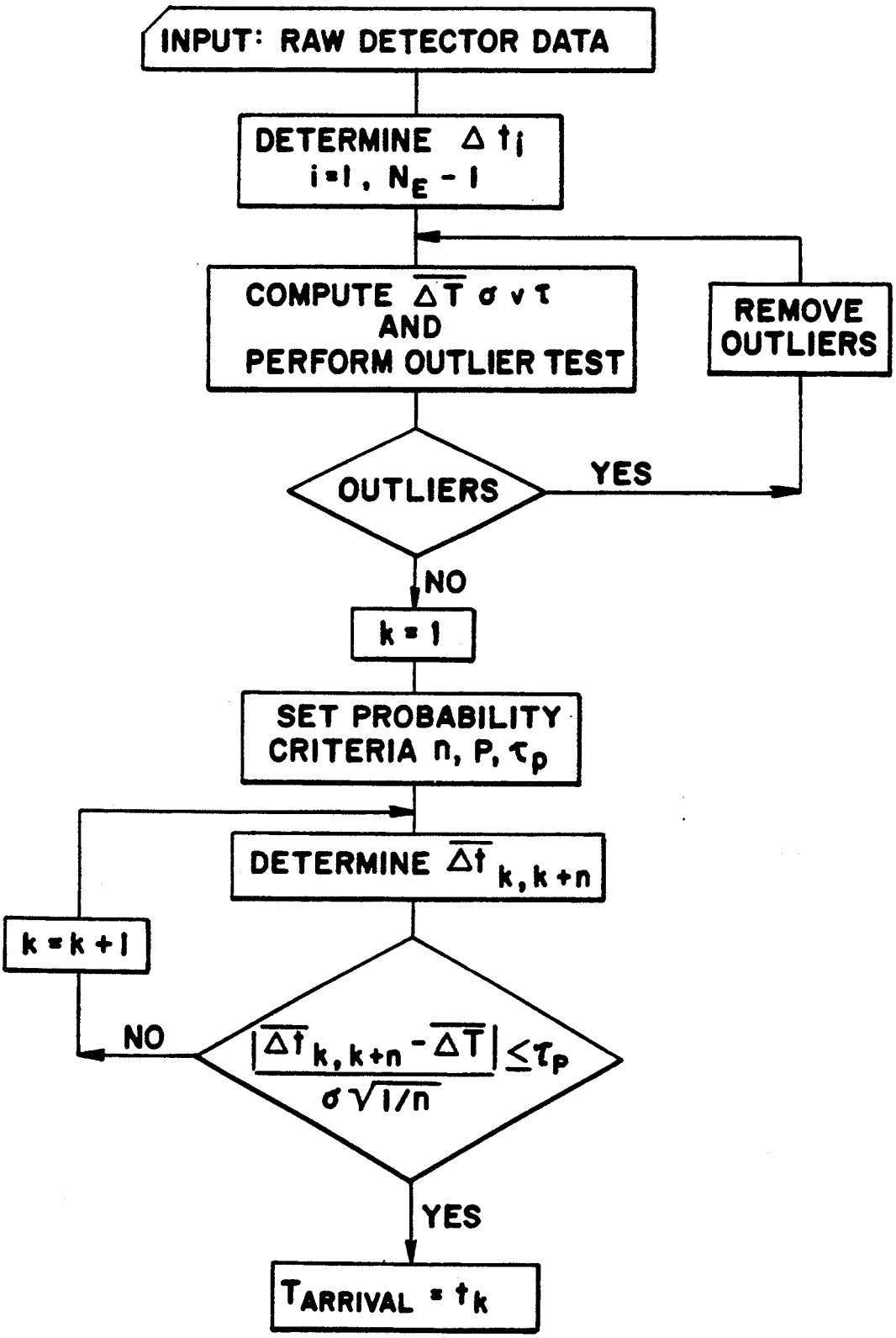
FIG. 6 is a flow chart that schematically illustrates the new, improved method for determining a transit time of a radioactive tracer.

A proposed analysis procedure of the new, improved method of determining tracer transit times is outlined in FIG. 6. The procedure for each set of detector data is as follows:

1. Transform raw output signal transmitted from each detector (the recorded time of each detected radiation decay event, $t_i$) into a new data set consisting of time intervals between successive decay events, $\Delta t_i$, and having a number of members equal to the total number of recorded radiation decay events minus one, $N_E-1$.

$$\Delta t_1 = t_2 - t_1$$
$$\Delta t_2 = t_3 - t_2$$
$$\vdots$$
$$\Delta t_i = t_{i+1} - t_i$$
$$\Delta t_{NE} - 1 = t_{NE} - t_{NE} - 1$$

2. Perform outlier test, such as Thompson's $\tau$ test, on time interval data to identify and separate those time intervals that are associated with tracer radiation decay events from those associated with background radiation decay events.
3. Compute the average and standard deviation of the identified time intervals associated with tracer radiation decay events, $\overline{\Delta T}$ and $\sigma$.
4. Establish an acceptable range or limit about the average time interval associated with tracer decay events using a specified sample size, n, and a specified confidence level, P, usually equal to 95% or 99%. This limit is set to ensure a high probability that background radiation decay events are not included in the determination of the tracer arrival time at each detector.
5. Divide total time interval data set, consisting of $N_E-1$ members, into subgroups of specified sample size, n. Each subgroup consists of n members beginning with member k and ending with member k+n. For example, the first subgroup consists of members $\Delta t_1, \Delta t_2, \ldots, \Delta t_{1+n}$; the second subgroup consists of members $\Delta t_2, \Delta t_3, \ldots, \Delta t_{2+n}$; and the kth subgroup consists of $\Delta t_k, \Delta t_{k+1}, \ldots, \Delta t_{k+n}$.
6. determine the average of the time intervals for each subgroup, $\overline{\Delta t_{k,k+n}}$, and identify a first subgroup, k, which falls within the acceptable limit of $$\overline{\Delta T} \pm \frac{\tau_p \sigma}{\sqrt{n}}$$

7. Set tracer arrival time at detector, $T_{arrival}$, equal to the corresponding time of decay event k, $t_k$.

Figure 7:
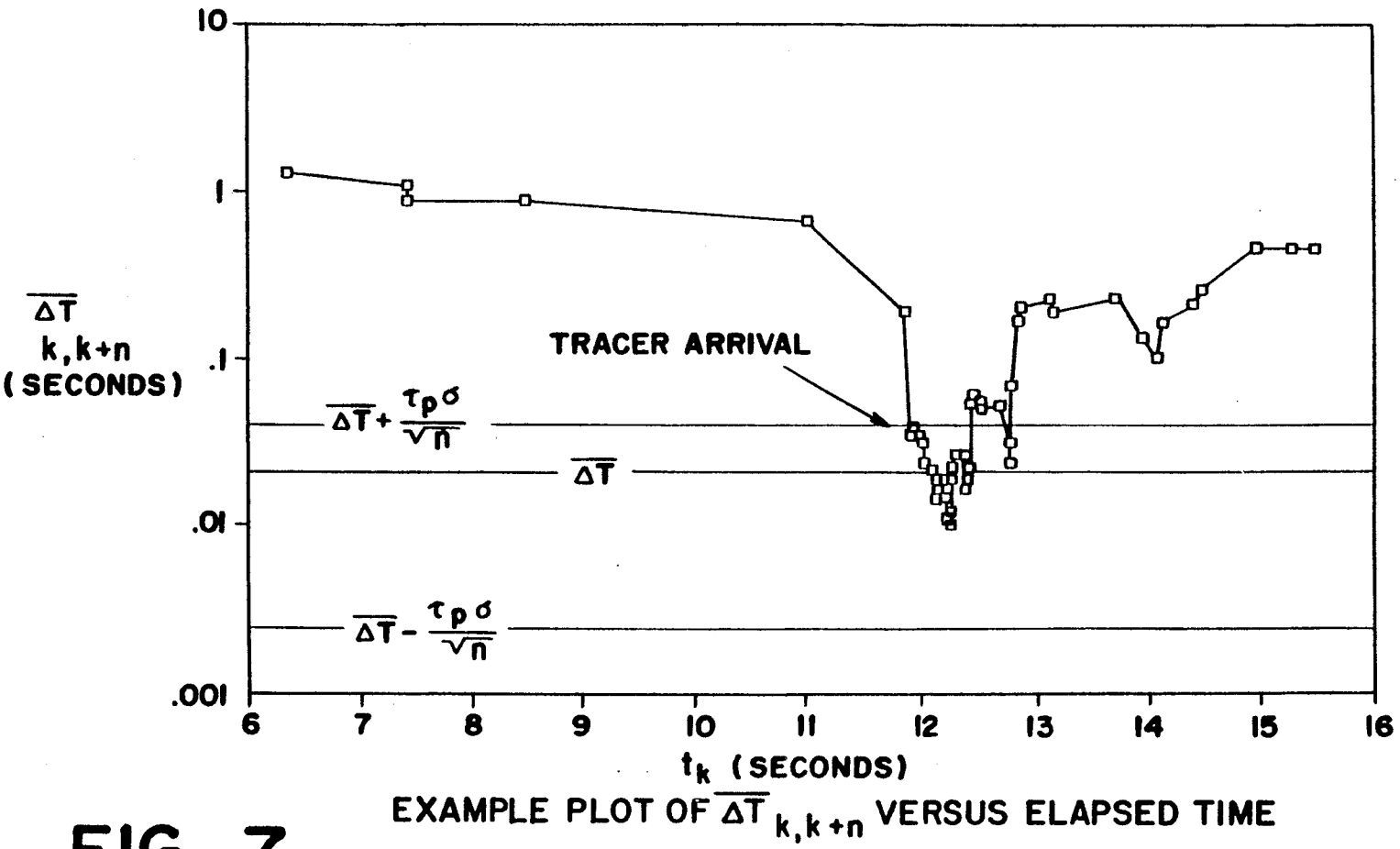
FIG. 7 is a plot showing a sample detector response curve to illustrate the new, improved method for determining a transit time of a radioactive tracer.

An example of a sample response curve for the inventive method is shown in FIG. 7, where $\Delta T_{k,k+n}$ is plotted versus recorded times of the radiation decay events, $t_k$. The arrival time of the tracer at the detector is identified as the time, $T_{arrival}=t_k$, corresponding to the first value of $\overline{\Delta t_{k,k+n}}$ that lies within the limit $$\overline{\Delta T} \pm \frac{\tau_p \sigma}{\sqrt{n}}$$

Once the tracer arrival times have been determined for each detector, the transit time between detectors is computed from $$\Delta T_{transit} = T_{arrival,\ bottom\ detector} - T_{arrival,\ top\ detector}$$

This process is repeated for dual detector data collected at different locations and the injection profile is determined from the change in transit times across the perforated interval.

The invention described herein can be useful in applications beyond those discussed above. For example, the invention can find application with well-to-well tracer surveys which are used in combination with other cased hole logs, such as temperature, compensated neutron, and formation-density, to determine areal sweep, rate of advance, and vertical coverage of steam injected into the reservoir. Tracers also are becoming more widely used in other related fields, such as geothermal energy, hydrology, and underground storage disposal.

What is claimed is:

1. A method for determining steam profiles in a steam injection well, comprising the steps of:
   a. inserting a first upper and a second lower gamma radiation detector at known depths in said well;
   b. collecting raw radiation decay data at each of said detectors, said raw radiation decay data comprising background noise and tracer radiation decay events which are distinguishable from said background radiation decay events;
   c. transforming said raw radiation decay data collected at each of said detectors into a new data set, consisting of time intervals between successive raw radiation decay events, and having a number of members equal to a total number of collected radiation decay events minus one, $N_E-1$;
   d. utilizing certain statistical criterion, such as outlier tests, to distinguish said tracer radiation decay events from said background radiation decay events, for each of said detectors;

e. computing an average and a standard deviation of said time intervals of said tracer radiation decay events, for each of said detectors;

f. establishing a limit about said average time interval to ensure a high probability that said background radiation decay events are not included in a determination of tracer arrival time, based on a specified confidence level, such as 95% confidence level, which indicates that there is a 95% probability that said average time interval data for said tracer radiation decay events will fall within this limit;

g. dividing said new data set of $N_E-1$ time intervals into subgroups of a specified sample size, n, such that there are $N_E-n$ number of subgroups consisting of the members $\Delta t_k, \Delta t_{k+1}, \Delta t_{k+2}, \ldots, \Delta t_{k+n}$, where k is a counter that goes from 1 to $N_E-n$, for each of said detectors;

h. determining an average of said time intervals for each of said subgroups, and identifying a first subgroup, k, whose average, $\Delta t_{k,k+n}$, lies within said acceptable limit about $\Delta T$ for each of said detectors;

i. setting an arrival time of the radioactive tracer, $T_{arrival}$, equal to a recorded time of decay event k, $T_{arrival}=t_k$, for each of said detectors;

j. computing said transit time, $\Delta T_{transit}$, of said radioactive tracer between said detectors, wherein $\Delta T_{transit}=T_{arrival}$, bottom detector, $=T_{arrival}$, top detector;

k. determining, by use of said transit time, an amount of fluid entering a formation between said first and said second gamma radiation detectors; and l. continuing to inject steam if said amount of fluid entering said formation between said detectors is an optimum amount, or diverting said fluid to flow into a different portion of said formation.

2. A method for determining steam profile, in a steam injection well, comprising the steps of:

a. inserting a first upper and a second lower gamma radiation detector at known depths in said well;

b. collecting raw radiation decay data at each of said detectors, said raw radiation decay data comprising background noise and tracer radiation decay events which are distinguishable from said background radiation decay events;

c. transforming said raw radiation decay data collected at each of said detectors into a new data set, consisting of time intervals between successive raw radiation decay events, and having a number of members equal to a total number of collected radiation decay events minus one, $N_E-1$;

d. utilizing certain statistical criterion, such as outlier tests, to distinguish said tracer radiation decay events from said background radiation decay events, for each of said detectors;

e. computing an average and a standard deviation of said time intervals of said tracer radiation decay events, for each of said detectors;

f. establishing a limit about said average time interval to ensure a high probability that said background radiation decay events are not included in a determination of tracer arrival time, based on a specified confidence level, such as 95% confidence level, which indicates that there is a 95% probability that said average time interval data for said tracer radiation decay events will fall within this limit;

g. dividing said new data set of $N_E-1$ time intervals into subgroups of a specified sample size, n, such that there are $N_E-n$ number of subgroups consisting of the members $\Delta t_k, \Delta t^{k+1}, \Delta t_{k+2}, \ldots, \Delta t_{k+n}$, where k is a counter that goes from 1 to $N_E-n$, from each of said detectors;

h. determining an average of said time intervals for each of said subgroups, and identifying a first subgroup, k, whose average, $\Delta t_{k,k+n}$, lies within said acceptable limit about $\Delta T$ for each of said detectors;

i. setting an arrival time of the radioactive tracer, $T_{arrival}$, equal to a recorded time of decay event k, $T_{arrival}=t_k$, for each of said detectors;

j. computing said transit time, $\Delta T_{transit}$, of said radioactive tracer between said detectors, wherein $\Delta T_{transit}=T_{arrival}$, bottom detector, $=T_{arrival}$, top detector;

k. arranging said transit time data in a manner so that said steam injection profile of said steam injection well can be determined;

l. determining said steam injections profile; and m. continuing to inject steam if said amount of fluid entering said formation between said detectors is an optimum amount, or diverting said fluid to flow into a different portion of said formation.

* * * * *